United States Patent [19]

Lohnherr

[11] 3,957,212

[45] May 18, 1976

[54] ROLL CRUSHING MILL

[75] Inventor: Ludger Lohnherr, Diestedde, Germany

[73] Assignee: Polysius AG, Neubeckum, Germany

[22] Filed: Feb. 18, 1975

[21] Appl. No.: 550,863

[30] Foreign Application Priority Data

Feb. 25, 1974 Germany ..... 7406586[U]

[52] U.S. Cl. ..... 241/110; 241/114

[51] Int. Cl.[2] ..... B02C 15/00

[58] Field of Search ..... 241/105, 106, 109, 110, 241/114, 115, 116, 117, 119, 120

[56] References Cited

UNITED STATES PATENTS

| | | | |
|---|---|---|---|
| 306,145 | 10/1884 | Goodson | 241/115 X |
| 614,074 | 11/1898 | Banfield | 241/116 |
| 1,345,715 | 7/1920 | Stevenson | 241/116 |
| 2,124,128 | 7/1938 | Seroy | 241/105 X |
| 3,366,338 | 1/1968 | Barton | 241/119 X |

*Primary Examiner*—Granville Y. Custer, Jr.
*Attorney, Agent, or Firm*—Learman & McCulloch

[57] ABSTRACT

A roll crushing mill comprises rollers rollable in concentric, trough-like grinding tracks. Material to be crushed is delivered to the innermost track in the path of the associated rollers. Crushed material passes from the innermost track over a vertically adjustable barrier ring into the outer track in the path of the associated rollers. Crushed material passes out of the outer track over a further barrier ring which also may be vertically adjustable.

10 Claims, 4 Drawing Figures

ROLL CRUSHING MILL

This invention relates to a vertical axis roll crushing mill with a grinding plate having an annular grinding track and roll bodies rolling on the grinding track and formed as rollers or balls, wherein the material to be crushed is fed in at the periphery of the inner grinding track, while the crushed material moves outwards on the grinding track which it leaves at the outer rim, and wherein the grinding track has at least two concentrically disposed sections of track at about the same level, each hollowed out to give a trough-shaped cross-section.

In a known roll mill construction the grinding track is formed as a single annular grinding surface with a trough-shaped recess on which a resiliently mounted pair of rolls roll to provide a type of two-stage crushing of the incoming material. As the material travels over the grinding track it first is engaged by the inner roll and then by the outer roll, before it leaves the track at the outer rim thereof. A serious defect of this known construction is that the crushing of the material is relatively uncontrolled, so that an undesirably high proportion of coarse material (grit) leaves the grinding track.

In another known roll mill of the type initially described, the grinding track can be divided into a number of concentrically disposed annular grinding track sections at about the same level, each hollowed out in a generally trough-shaped cross-section, resulting in a somewhat corrugated surface for the grinding track. In similar manner the outer surface of a grinding body, formed as a roll, and which comes into contact with the grinding track is also formed with corrugated raised portions which engage in the corresponding sections of grinding track. While this formation of the grinding track does produce an improved multi-stage crushing of the feed stock, there is however also a risk of the material reaching the outer rim of the track relatively quickly, and there being extracted while it in part is insufficiently reduced. A further disadvantage is the complicated machining of the grinding body peripheral surface.

The object of this invention is to provide an improved roll mill of the general type described, whereby with a relatively simple construction the crushing operation is improved as compared with known constructions. A roll mill according to the invention makes it possible to regulate the rate at which the material moves outwards over the grinding track.

According to the invention a barrier ring, adjustable in height, for the material to be crushed is disposed in the transition zone between two adjacent sections of grinding track. In this manner the freshly supplied material is first retained for a sufficient period on the inner section of grinding track, and particularly intensively ground by a roll body movable relative to the grinding track, before the material moves over the barrier ring to the next section of track and hence further outwards on the grinding track. On the next section of track there is then a further crushing of the already greatly reduced material. If for instance there are present two concentrically disposed sections of grinding track, the crushed material then leaves the track and hence the grinding plate over the outer rim of the outer grinding track section, which in this case forms the outer rim of the grinding plate. The provision of this barrier ring for the material, and in particular the adjustability of its height, ensures a highly controlled and intensive crushing of the feed stock, and consequently a greatly improved distribution of the stock over the entire grinding track, with relatively low constructional cost. The ability to adjust the height of the barrier ring between two adjacent sections of grinding track at the same time permits regulation of the rate at which the material moves outward across the grinding track.

Because of the more intensive crushing of the supplied material the proportion of particles still insufficiently crushed (the grit) can be greatly reduced. This has especial significance in instances such as is normally the case with sprung roll mills for example, wherein an air sifter is also disposed above the actual roll mill, so that the ground material emerging over the grinding track edge is entrained with the aid of an air stream. Because of the reduced proportion of grit the differential pressure with this type of plant can be notably lower, and this again means correspondingly less power requirements.

According to a further development of the invention, in a roll mill formed as a sprung roll mill having rolls cooperating with the grinding track, it can be advantageous if pairs of rollers are disposed on the inner and outer sections of grinding track with the two rolls in each pair lying generally diametrically opposite each other on the corresponding section of annular track, and with the geometrical axes of rotation of the two pairs of rollers offset from each other by about 90° and intersecting on the vertical axis of the mill. The main advantage of such a construction arises with larger mill units, wherein the individual rolls, and thus the pairs of rolls even more so, have considerable weight. With this further development of the invention the four individual rolls of the two pairs can be uniformly disposed on the grinding track.

Two embodiments of the invention are disclosed in detail in the drawings, wherein:

FIG. 1 shows a vertical axis roll mill in accordance with the invention, and consisting of a sprung roll mill 1; for simplicity, only the main parts needed for explaining the invention are shown. An air sifter, not shown but constructed in known manner, may for instance be disposed above the actual sprung roll mill, and in the same housing.

Figure 1:
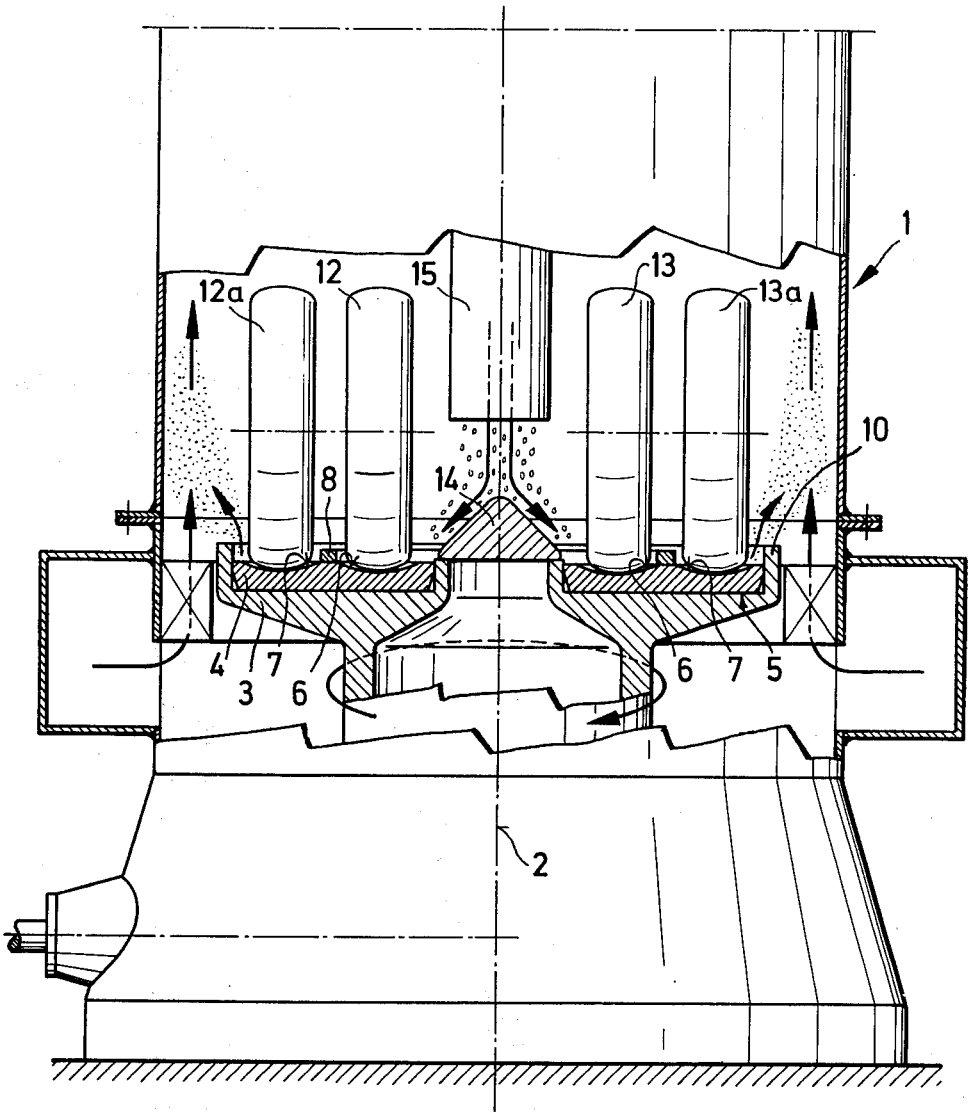
FIG. 1 is a partly sectioned view of part of a roll mill in accordance with the invention and formed as a sprung roll mill.

The sprung mill 1 comprises a grinding dish 3 rotating about the vertical mill axis 2 and carrying a grinding plate 4. This grinding plate 4, formed as a ring, has on its upper surface an annular grinding track 5, divided in this instance into two grinding track sections 6,7 disposed concentrically with each other at about the same height and hence also annular. Both the inner grinding track section 6 and the outer section 7 are hollowed out to a trough-like cross-section. The track sections 6 and 7 are spaced by a transition area. Mounted at the transition area between the track sections is a barrier ring 8, adjustable in height, for the material being ground, and affixed by means of screws 9 to the grinding track or grinding plate 4. This barrier ring 8 can be formed from several parts, consisting for instance of a number of separable, superimposed ring sections (to determine the required barrier height) and/or of a number of annular segments (for ease in assembly and disassembly).

Figure 2A:
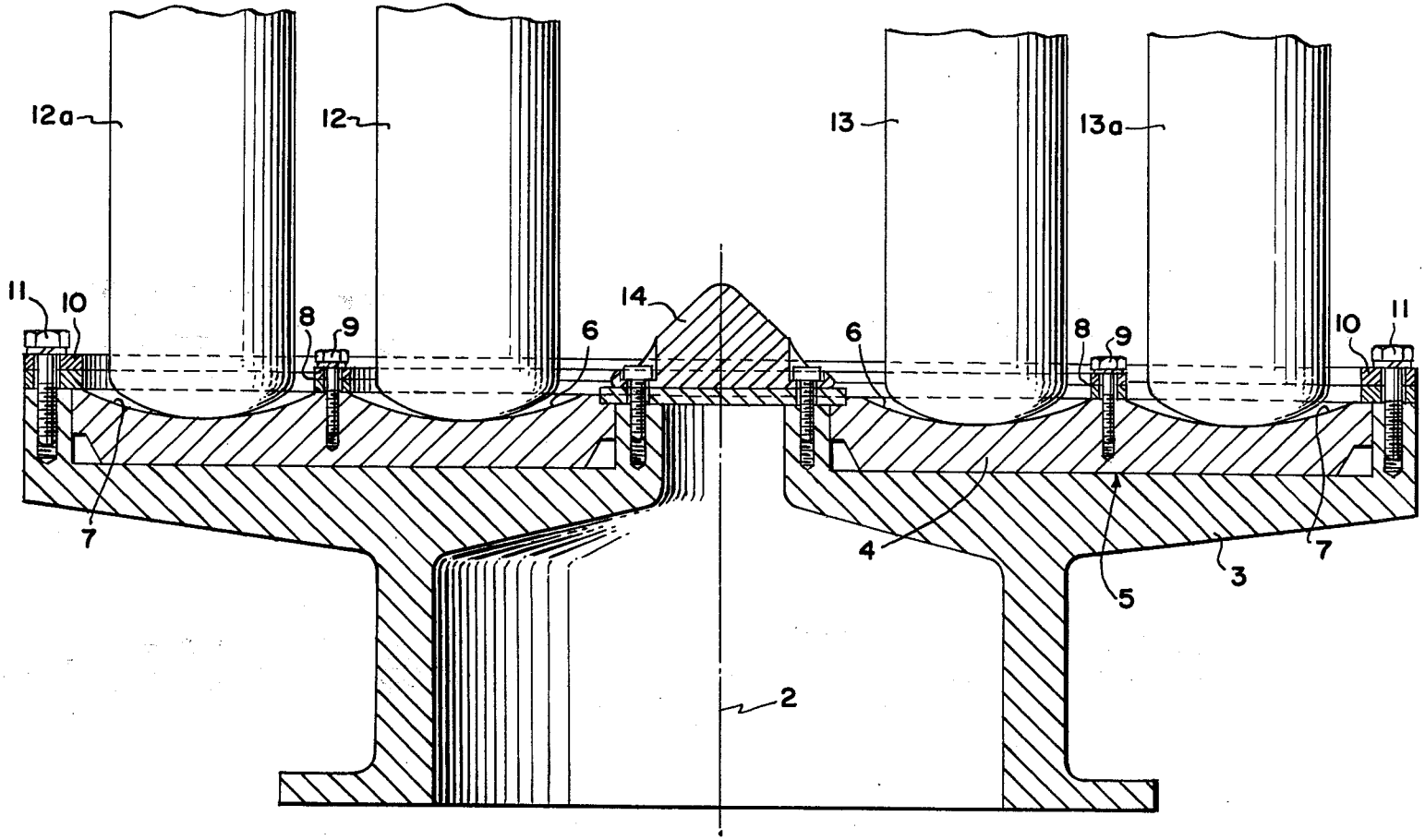
FIG. 2A is an enlarged view similar to FIG. 2 and illustrating constructional details.
Figure 2:
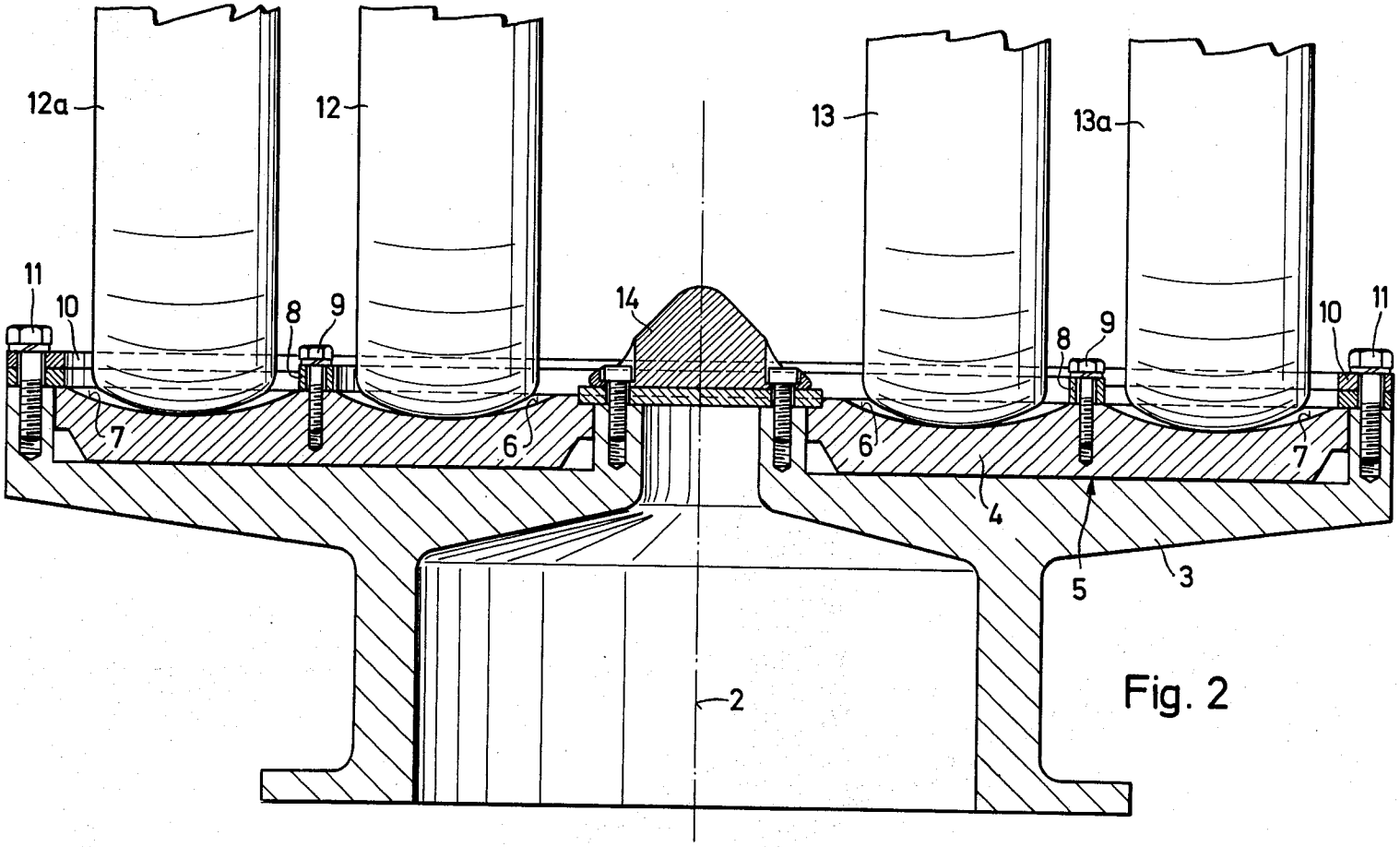
FIG. 2 is a portion of FIG. 1 shown on enlarged scale, and showing in particular the form of the grinding track and the barrier ring.

As is best shown in FIG. 2, the grinding plate 4 is interchangeably inset in a corresponding recess in the grinding dish 3. In addition the outer rim of the grinding dish 3 is formed with an outer barrier ring 10 at the outer periphery of the grinding track 5. This outer barrier ring may on the one hand merely comprise an elevated outer rim to the grinding dish; but on the other hand it is advantageous if as shown in FIG. 2 this ring also comprises a separate multipart ring (like the barrier ring 8), affixed by means of screws 11.

On the grinding track 5 travel the rolls 12, 12*a* and 13, 13*a* forming the roll body and individually spring-mounted in a manner not shown, but well known. In this embodiment the rolls 12, 12*a* and 13, 13*a* are assembled in pairs in such manner that the rolls of each pair (eg 12, 12*a*) lie adjacent each other on the same annular section of the grinding track 5, but the roll 12 or 13 of each pair which lies innermost in relation to the vertical axis 2 of the mill lies on the inner section 6 of grinding track and the outer roll 12*a* or 13*a* of a pair travels along the outer section 7 of grinding track.

As is best shown in FIG. 2, the trough-shaped depression in the grinding track sections 6, 7 is in general symmetrical; on their outer peripheries which come into contact with the grinding track sections, the rolls 12, 12*a*, 13, 13*a* also have symmetrical (as seen in cross-section) outwardly curved peripheral surfaces. The trough-shaped depressions in the grinding track sections 6, 7 are largely matched in shape to the peripheral surfaces with which they cooperate on the rolls 12, 12*a*, 13, 13*a*.

If the sprung roll mill provided by the invention is mainly used for crushing highly erosive material, at least those parts of the surface of the grinding track 5 which come into contact with the rolls preferably comprise inserts of specially wear-resistant material.

In the area of the central annular aperture of the grinding track 5 there is also provided a distributor cone 14, whereby material coming from a central feed pipe 15 and which is to be crushed is uniformly distributed on the inner section 6 of the grinding track 5.

Figure 3:
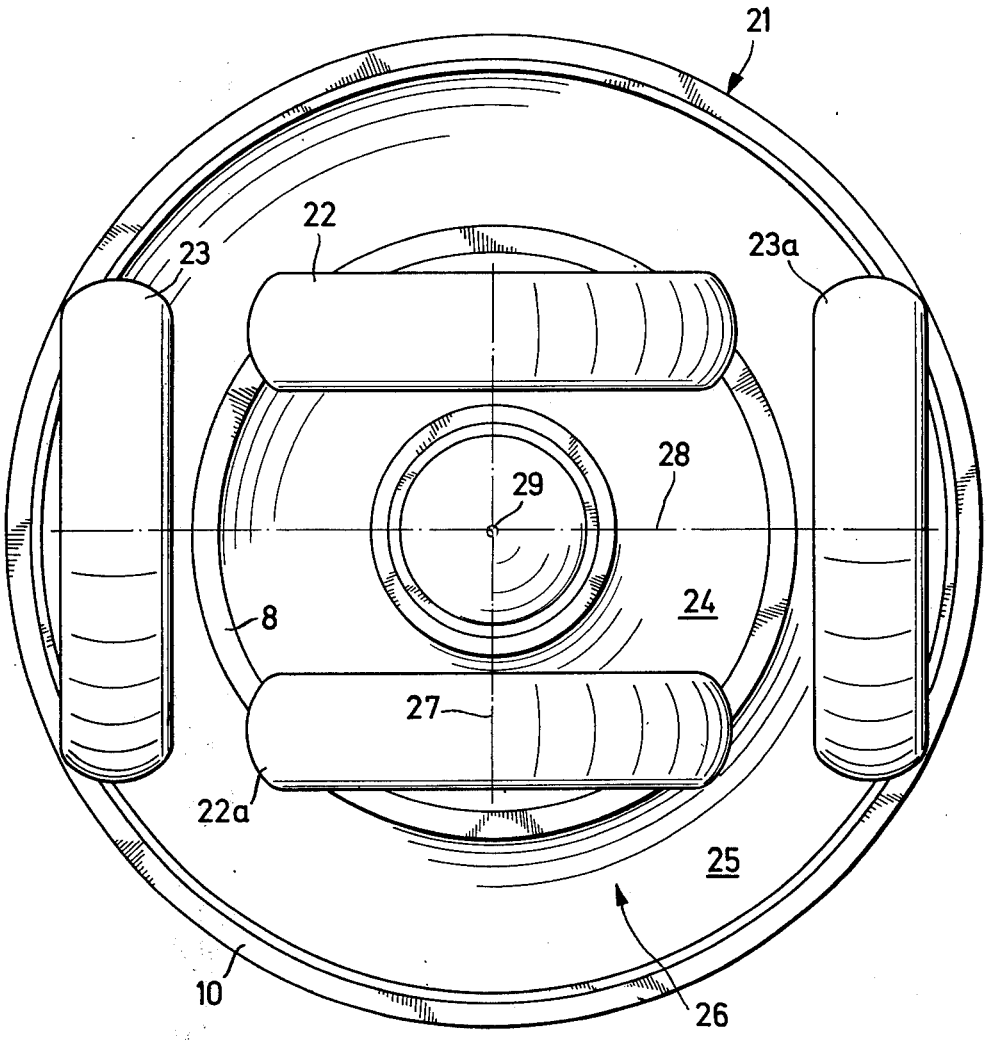
FIG. 3 is a schematic plan view of a further embodiment of the invention.

A further embodiment of a roller crushing mill in accordance with the invention, also formed as a sprung roll mill 21, is shown in FIG. 3. In the first embodiment (FIGS. 1 and 2) the rolls of the individual roll pairs are disposed relatively close to each other on the grinding track, and the two pairs of rolls are disposed generally diametrally opposite each other on the grinding track ring (with the same axis of rotation). In the embodiment of FIG. 3, however, the individual rolls 22, 22*a*, and 23, 23*a* are so disposed that they correspond respectively to the inner and outer sections 24, 25 of the grinding track 26, so that the two rolls (eg 22, 22*a*) of a given pair lie diametrally opposite each other on the corresponding annular section of grinding track (eg 24) and have the same geometrical axis of rotation 27 or 28. In this case the two pairs of rolls (22, 22*a* and 23, 23*a*) are so disposed in relation to each other on the grinding track 26 that their geometrical axes of rotation 27,28 are offset from each other by about 90° and intersect on the vertical axis 29 of the mill (perpendicular to the plane of the drawing). In this way an extremely favourable weight distribution of the rolls on the grinding track is achieved, which is of especial advantage for large mill units. The remaining construction of the grinding track with the barrier ring 8 (as described in relation to the first example) therefore remains unchanged.

It is self-evident that the roll crushing mill in accordance with the invention can also be provided with other types of rollers or balls which then travel along the corresponding grinding track sections, between which a barrier ring is provided for the material in the manner described.

What is claimed is:

1. A vertical axis roll crushing mill comprising a grinding plate having an annular grinding track composed of at least two concentric trough-shaped track sections at substantially the same level spaced by a transition zone; roll bodies rollable in said track sections; means for delivering material to the innermost track section; adjustable height barrier ring means interposed between each of said track sections at said transition zone; and means acting between said plate and said barrier ring means for securing the latter to said plate at said transition zone.

2. A mill according to claim 1 wherein said ring means comprises a plurality of separate rings arranged in a stack.

3. A mill according to claim 2 wherein each of said rings is composed of a plurality of parts.

4. A mill according to claim 1 wherein the surfaces of said trough-shaped track sections correspond substantially to the surfaces of said roll bodies.

5. A mill according to claim 1 wherein said grinding track is removably mounted in a supporting dish.

6. A mill according to claim 5 wherein said grinding track is composed of wear resistant material.

7. A mill according to claim 5 wherein said grinding plate extends beyond the outermost track section to form an outer rim, and including further barrier ring means carried by said rim and extending above the level of said track sections.

8. A mill according to claim 7 wherein said further barrier ring means is adjustable in height.

9. A mill according to claim 1 wherein said roll bodies comprise a pair of rolls for each of said track sections, all of said rolls being rotatable about a common axis of rotation.

10. A mill according to claim 1 wherein said roll bodies comprise a pair of rolls for each of said track sections, the rolls of each pair being diametrically opposite one another and the axis of rotation of the rolls of the innermost track section being offset by substantially 90° from the axis of rotation of the rolls of the outermost track section with said axes intersecting substantially on the vertical axis of said mill.

* * * * *